US006887369B2

(12) United States Patent
Moulton et al.

(10) Patent No.: US 6,887,369 B2
(45) Date of Patent: May 3, 2005

(54) PRETREATMENT PROCESSES FOR HEAVY OIL AND CARBONACEOUS MATERIALS

(75) Inventors: David S. Moulton, Hondo, TX (US); Jimell Erwin, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 263 days.

(21) Appl. No.: 10/244,380

(22) Filed: Sep. 17, 2002

(65) Prior Publication Data

US 2003/0062163 A1 Apr. 3, 2003

Related U.S. Application Data

(60) Provisional application No. 60/322,448, filed on Sep. 17, 2001.

(51) Int. Cl.[7] ..... C10G 47/00; C10G 45/02

(52) U.S. Cl. ..... 208/107; 208/208 R; 208/209; 208/251 H; 208/254 H; 208/952

(58) Field of Search ..... 208/106, 107, 208/208 R, 209, 251 H, 254 H, 952

(56) References Cited

U.S. PATENT DOCUMENTS

| | | | | |
|---|---|---|---|---|
| 3,453,206 A | | 7/1969 | Gatsis | |
| 3,989,618 A | * | 11/1976 | McCollum et al. | 208/106 |
| 4,108,760 A | * | 8/1978 | Williams et al. | 208/390 |
| 4,252,634 A | | 2/1981 | Khulbe et al. | |
| 4,483,761 A | * | 11/1984 | Paspek, Jr. | 208/106 |
| 4,485,003 A | | 11/1984 | Coenen et al. | |
| 4,557,820 A | | 12/1985 | Paspek, Jr. et al. | |
| 4,559,127 A | * | 12/1985 | Paspek, Jr. | 208/115 |
| 4,564,458 A | | 1/1986 | Burleson | |
| 4,743,357 A | * | 5/1988 | Patel et al. | 208/113 |
| 4,766,099 A | | 8/1988 | Dufresne et al. | |
| 4,818,370 A | * | 4/1989 | Gregoli et al. | 208/106 |
| 4,840,725 A | | 6/1989 | Paspek | |
| 4,963,247 A | | 10/1990 | Belinko et al. | |
| 4,999,328 A | | 3/1991 | Jain et al. | |
| 5,466,363 A | | 11/1995 | Audeh et al. | |
| 5,591,325 A | | 1/1997 | Higashi | |
| 5,779,992 A | | 7/1998 | Higashi | |
| 5,948,721 A | | 9/1999 | Yuansheng et al. | |
| 6,004,454 A | | 12/1999 | Yuansheng et al. | |
| 6,068,758 A | | 5/2000 | Strausz | |

FOREIGN PATENT DOCUMENTS

| | | | | |
|---|---|---|---|---|
| JP | 9-188501 | | 7/1997 | |
| JP | 11166183 A | * | 6/1999 | C10G/1/04 |

* cited by examiner

*Primary Examiner*—Walter D. Griffin
(74) *Attorney, Agent, or Firm*—Oliff & Berridge, PLC

(57) ABSTRACT

A process for treating a carbonaceous material includes reacting the carbonaceous material and a process gas in supercritical water to at least one of hydrotreat and hydrocrack the carbonaceous material to form a treated carbonaceous material. The process is preferably carried out in a deep well reactor, but can be carried out in conventional surface-based reactors at a temperature of at least 705° F. and a pressure of at least 2500 psi.

16 Claims, 1 Drawing Sheet

PRETREATMENT PROCESSES FOR HEAVY OIL AND CARBONACEOUS MATERIALS

This application claims the benefit of 60/322,448 filed Sep. 17, 2001.

BACKGROUND OF THE INVENTION

1. Field of Invention

The present invention relates to a pretreatment processes that can be applied to heavy oil or other carbonaceous materials to change properties of the heavy oil or carbonaceous materials. More particularly, the present invention relates to pretreatment processes that can make a material, which otherwise would not be suitable for use in refining processes and the like, amenable to such processes. The pretreatment processes change properties of the heavy oil or carbonaceous materials, such as one or more of removing impurities or undesired content, reducing the viscosity, reducing molecular weight, reducing the specific gravity, and the like.

2. Description of Related Art

Many oils from natural sources as well as residue feeds, particularly bitumen (heavy oil), contain small quantities of heteroatoms (sulfur, oxygen and nitrogen), halides, and metals (such as nickel, vanadium and iron). Generally, removing these substances from the heavy oils or other carbonaceous materials increases the utility and adds value of the heavy oils or carbonaceous material, and can permit the heavy oil or carbonaceous material to be refined where otherwise refining would be difficult or impossible. However, refining and/or conversion of such crude materials is generally costly due to the cost and materials needed to process the crude materials. Furthermore, as environmental pressures continue to lower allowable emission levels in gas and diesel products, refining costs continue to rise.

One method for removing such heteroatoms, halides and/or metals from the crude materials is the well-known hydrotreating process. According to the hydrotreating process, the undesired atoms and elements are removed from the crude material by treating the crude material and related products with hydrogen in a packed-bed catalytic reactor. Such processes are well known in the art, and have been practiced extensively particularly in the refining industry.

For example, U.S. Pat. No. 5,779,992 and U.S. Pat. No. 5,591,325 each disclose apparatus and processes for hydrotreating heavy oils in a fixed-bed reactor packed with a hydrotreating catalyst. Such processes and apparatus are also disclosed, for example, in U.S. Pat. No. 5,466,363. Each of the afore-mentioned patents is incorporated herein in their entirety by reference.

An alternative method for improving the value and usefulness of heavy oils and other carbonaceous materials is the well-known hydrocracking method. The hydrocracking method is particularly useful for heavy oils and carbonaceous materials that have unusually high molecular weights, unusually high viscosity and/or unusually high specific gravities. The value of such crude materials could be improved by treatment processes that decrease their molecular weight, viscosity, and/or specific gravity. In such hydrocracking processes, a solid catalyst is used to crack, or reduce the molecular weight of, the crude material. This in turn generally provides a product with reduced viscosity and a reduced specific gravity. Such hydrocracking processes are also well-known in the art, and particularly, in the refining industry.

For example, U.S. Pat. No. 6,068,758 discloses a process for hydrocracking heavy oil using a catalyst. The catalyst comprises a mixture of hydrocracked residual asphaltene and metal-doped coke. U.S. Pat. Nos. 6,004,454 and 5,948,721 disclose processes for hydrocracking heavy oils using a disposing-type catalyst for catalytic hydrocracking of heavy oil and residuum in a suspension bed hydrocracking process. Other hydrocracking processes are disclosed in, for example, U.S. Pat. Nos. 4,999,328, 4,963,247, 4,766,099, and 4,252,634. All of the foregoing references are incorporated herein in their entirety by reference.

However, despite the various known treatment methods, many heavy oils and other carbonaceous materials can not be sufficiently pretreated to permit their further processing in current refinery operations. Thus, for example, many heavy oils and other carbonaceous materials can not be suitably subjected to catalytic hydrotreating or catalytic hydrocracking to permit their father refinement. For example, many of the heavy oils and carbonaceous materials result in unacceptable fouling of the catalyst or related processing equipment, thereby making their treatment economically unfeasible.

In an effort to address the problems in pretreating such heavy oils and carbonaceous materials for further refinery processing, an alternative method for treating such materials with a reducing gas and a supercritical water environment has been developed. The method produces results similar to hydrotreating, but it has not been commercially practiced due to the cost and difficulties of making the reaction work in conventional equipment. Such a process is disclosed in, for example, U.S. Pat. Nos. 4,485,003 and 4,840,725, the entire disclosures of which are incorporated herein by reference. In U.S. Pat. No. 4,485,003, a process is disclosed for producing liquid hydrocarbons from coal, comprising treating comminuted coal at 380° C. to 600° C. and at a pressure of 260 to 450 bar with water in a high pressure reactor to form a charged supercritical gas phase and a coal residue. Simultaneous with the water treatment, hydrogenation with hydrogen takes place in the presence of a catalyst. Subsequent to the reaction, the gas phrase is divided into several fractions by lowering its pressure and temperature, and energy and/or gas is generated from the coal residue. In a similar manner, U.S. Pat. No. 4,840,725 discloses a process for converting heavy hydrocarbon oil feedstocks to fuel range liquids. The process comprises contacting the high boiling hydrocarbons with water at a temperature of from about 600° F. to about 875° F. at a pressure of at least about 2000 psi in the absence of an externally supplied catalyst. The water and high boiling hydrocarbon form a substantially single phase system under the elevated temperature and pressure conditions utilized.

SUMMARY OF THE INVENTION

However, despite the above-described methods and materials, the need continues to exist in the art for improved methods for treating heavy oils and other carbonaceous materials to prepare such crude materials for refinery processing.

According to the present invention, processes are provided for pretreating heavy oils and other carbonaceous materials (alternatively referred to herein as "crude materials"), particularly to make such crude materials suitable for subsequent use in refinery processing. The pretreatment processes of the present invention improve the quality and value of the crude materials, and provide economical ways for utilizing such crude materials. According to the present invention, heavy oils and other related materials are treated with a reducing gas in a supercritical water environment to cause hydrocracking of the crude materials. In embodiments, the use of a deep well reactor for reactions with reducing gases in a supercritical water environment produce hydrocracking in large volume and more economically than is conventionally available using surface-based supercritical water reactors. Further, in embodiments, the use of the deep well reactor for conducting the reactions with reducing gases in a supercritical water environment provide hydrotreating operations in large volumes and more economically than is conventionally available in surface-based supercritical water reactors.

Although the present application focuses upon pretreatment processes for heavy oils, it will be readily apparent to one of ordinary skill in the art that the present invention is equally applicable to any carbonaceous material, including heavy oils, bitumen, and related materials. The present invention provides a technical and economical means to apply the supercritical water processes to heavy oils, or other carbonaceous materials, for which conventional processing does not work for practical reasons, or for which economic considerations have heretofore limited commercial practice.

More particularly, the present invention provides a process for treating a carbonaceous material, comprising: reacting said carbonaceous material and a process gas in supercritical water to at least one of hydrotreat and hydrocrack said carbonaceous material to form a treated carbonaceous material.

In an embodiment of the present invention, the process is preferably carried out in a deep well reactor. In another embodiment of the present invention, the process is conducted at a temperature of at least 705° F. and a pressure of at least 2500 psi.

DETAILED DESCRIPTION OF PREFERRED EMBODIMENTS

Figure 1:
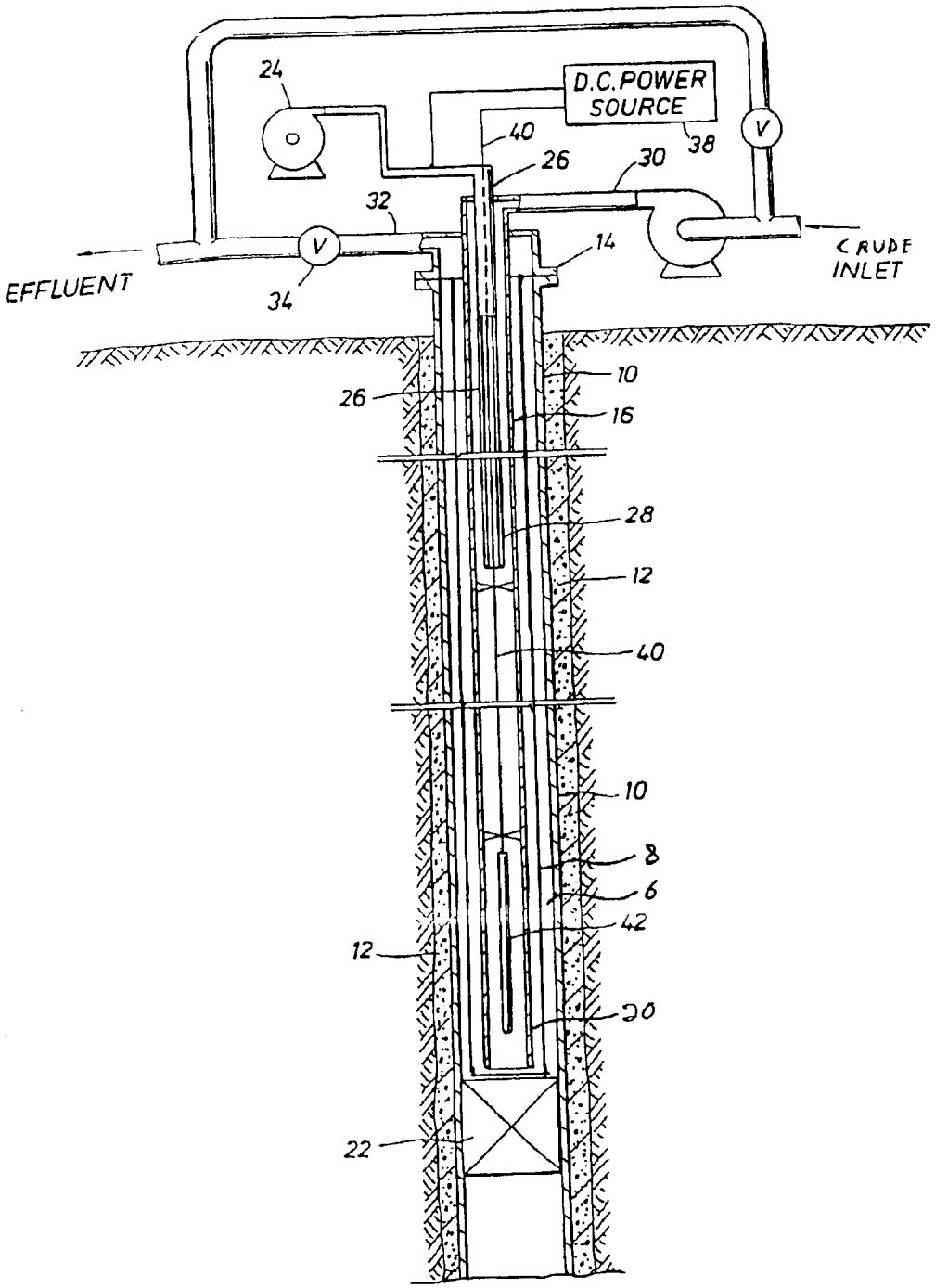
FIG. 1 shows a sectional view through a cased and cemented well showing a pressurized reaction chamber for conducting the process according to an embodiment of the present invention.

The present invention provides pretreatment processes for heavy oils and other carbonaceous materials. The present invention in particular provides supercritical water pretreatment processes that permit otherwise unusable heavy oils and carbonaceous materials to be improved, for subsequent refinery processing.

In general terms, the present invention provides a method for upgrading heavy oils or related materials, such as carbonaceous materials, to facilitate their subsequent processing in conventional oil refineries or other hydrocarbon processing facilities or equipment. As used herein "heavy oils" is used to refer to crude oils, or fraction thereof, which generally contain asphaltenes, resins, pitches, or tars, which are currently used primarily as feed for coking or related "carbon rejection" processes. Such heavy oils are thus not otherwise generally processed in conventional oil refineries or other hydrocarbon processing equipment because of their high viscosity, their high specific gravity, and/or the concentrations of atoms other than hydrogen and carbon. In practice, the processes of the present invention are equally applicable to heavy oils as well as to other carbonaceous materials such as coal, oil shale, tar sand, biological products, or a heavy oil derived from any of them.

As used in the present invention, "upgrading" means to change the properties of the heavy or other related material, preferable to make a product that is suitable for refinery use. Accordingly, "upgrading" within the scope of the present invention means to accomplish any or all of the following property changes: reduce the specific gravity, increase the hydrogen content; reduce the viscosity; reduce the average molecular weight; remove heteratoms such as sulfur, oxygen or nitrogen; remove metals such as nickel, vanadium and iron; remove other atoms or elements such as halides, halogen atoms, or atoms other than hydrogen and carbon; and the like. These effects, except for reducing the viscosity and/or average molecular weight, generally occur as a result of hydrogenation of the crude material, or the type of reactions that are generally employed in conventional hydrotreating processes. In contrast, the effects of reducing the viscosity, average molecular weight, and/or specific gravity of the crude material generally occur as a result of hydrocracking, similar to the types of reactions employed in conventional hydrocracking processes. Each of these different reactions upgrades the crude material. Any of these property changes individually, or in combinations of two or more, improve the acceptability of the heavy oil or carbonaceous material for subsequent conventional refining or other hydrocarbon processing. However, in contrast to prior art processes that are either unsuccessful or result in upgrading of the crude material at a high cost and/or in small volumes, the processes of the present invention provide upgrading of crude materials in large volumes and at low cost.

According to the present invention, the crude material (such as heavy oil or other carbonaceous material) is mixed with water and heated, along with a process gas, to cause hydrocracking of the heavy oil or other carbonaceous material. The heating is conducted under pressure, preferably in a suitable pressurized container. Accordingly, the processes of the present invention generally differ from the catalytic hydrocracking and catalytic hydrotreating of conventional processes, in that no solid catalyst is used, and that water is present. In this respect, water may function in the chemical reaction as a catalyst, thereby assisting in the hydrocracking reaction. In addition, the water may contain dissolved substances that function as catalysts, such as sodium or potassium carbonate, which are known to act as hydrogenation catalysts when carbon monoxide is present. Such dissolved catalyst species are thus encompassed within the scope of the present invention.

As a process gas, any suitable process gas may be used that accomplishes the hydrocracking objective of the present invention. Preferably, the process gas is either hydrogen, carbon monoxide, or a suitable synthesis gas such as a gas comprising a mixture of hydrogen and carbon monoxide. As used herein, "synthesis gas" refers to various reaction products of the crude material with steam and oxygen present in the reaction chamber to make hydrogen, carbon monoxide, and other product gases. Preferably, the process gas used in embodiments of the present invention is a synthesis gas, as the use of a synthesis gas rather than only hydrogen gas results in a desirable "shift reaction" between carbon monoxide and water to form additional hydrogen and carbon dioxide within the reactor. Of course, other suitable process gases can be used, as desired. Further, various mixtures of different process gases can be used as the process gas in embodiments of the present invention. Thus, for example, the process gas can be a mixture of hydrogen gas and a suitable synthesis gas.

The main reaction desired within the reactor chamber in embodiments of the present invention is hydrocracking, which refers to the simultaneous cracking and hydrogenation processes. "Cracking" means breaking bonds within the molecule to form two or more smaller molecules, which would be unsaturated at the point of cleavage. "Hydrogenation" likewise refers to the reaction of hydrogen with the hydrocarbon products to produce hydrocarbons that have a greater hydrogen content. Thus, for example, where a cracked molecule has unsaturated bonds due to the cracking operation, hydrogen can be added to the molecule at the point of unsaturation to produce saturated molecules having a higher hydrogen content. Other desirable reactions that may occur within the reactor during the processes of the present invention include the reaction between hydrogen and atoms other than carbon to remove the undesirable atoms from the mixture. For example, hydrogen can react with heteroatoms such as sulfur, oxygen, and nitrogen to produce, for example, hydrogen sulfide, ammonia, or water or can react with metal atoms to produce, for example, metal compounds. These various reaction products can then be removed from the processed crude material according to the known methods to provide a purified product stream.

In embodiments of the present invention, the pretreatment process is carried out at a suitable temperature to effect the hydrocracking reactions. In embodiments, the temperature is preferably from about 300 to about 1000° F. or more. Preferably, the temperature is from about 450 to about 900° F., and any more preferably is from about 600 or about 650, to about 750° F. or 800° F. However, it will be apparent that temperatures outside of these ranges can be used, if desired, depending on the crude material being processed and other conditions of the pretreatment process.

Likewise, the processes of the present invention may be carried out at any suitable pressure to permit the desired hydrocracking reactions to proceed. In embodiments of the present invention, the pressure is preferably about 1000 psi or higher. Preferably, the pressure is from about 1000 psi to about 6000 psi, more preferably from about 1500 psi to about 5000 psi. For example, a pressure of from about 2500 psi to about 3500 psi, or about 3000 psi, provides acceptable results. Of course, pressures outside of these ranges can be used, if desired, and based on the crude material and other process conditions.

In embodiments of the present invention, the pretreatment process can be carried out in any suitable and desirable pressurized reaction vessel that is capable of containing supercritical temperature and supercritical pressure reactions. Such reactor vessels are known in the art, and can be used in the present invention. This includes both surface-based reactor vessels and sub-surface reactor vessels, such as deep well reactor vessels. However, in the interest of increasing the economic and safety factors of practicing the present invention, a deep well reactor is preferred in embodiments of the present invention.

A suitable deep well reactor is disclosed in, for example, U.S. Pat. No. 4,564,458, the entire disclosure of which is incorporated herein by reference. Such a deep well reactor vessel is preferred, for example, because it allows for more economic operation, as well as improved safety, for the reactions that are carried out at the elevated temperatures and pressures described above. Whereas surface-based reactor vessels are relatively expensive, and typically require being designed for even higher pressures than are anticipated in actual operation, the deep well reactor vessel used in embodiments of the present invention is more economical because it requires less pressure equipment at the surface, and increased safety of operation is provided by the reactor being substantially enclosed in a deep well.

The present method is thus preferably conducted in a suitable reactor vessel that is located in a cased well. Such wells are typically drilled sufficiently deep to enable supercritical pressures to be obtained in the bottom area even without applying a pressure head to the reactor vessel from the surface. In the event that the well is not that deep, the well can nevertheless be used because the reactor feed can be pressurized. Accordingly, the pressure in the reactor vessel at the bottom at the well can be raised by incrementing the standing column of water and reactants with a pressure boost at the surface. Utilizing a rough rule of thumb that the pressure is increased by about one psi for every two feet of column height, a well that is approximately 6,000 feet deep will furnish a bottom hole pressure of approximately 3,000 psi. This can be done without pressurizing the well at the top. In this light, it should be recognized that the well encloses a standing column of water that increases the pressure to supercritical in the bottom or reaction area. The standing column is thus selectively boosted by providing a pressure head thereabove. While this pressure head may involve the installation of pressure retaining tanks, valves and the like connected at the well head, they are typically much less expensive as compared to the equipment otherwise necessary to contain 3,000 psi at the surface. Rather, the surface equipment might provide a pressure boost of perhaps 500 psi. This would be helpful in a well that might be only 5,000 feet deep.

As will be understood, the term pressure or reactor vessel is somewhat relative in this context when referring to the use of such a vessel in embodiments utilizing a deep well reactor. In such embodiments, it is intended to refer to the bottom portions of an abandoned or otherwise prepared or natural well. Preferably, the well is cased to prevent migration into the adjacent formations, and the reactor vessel is disposed within the casing. Moreover, the casing is preferably cemented in place to assure that the chamber at the bottom of the well will be available for continuous duty, use and operation. This is particularly important to enable heavy oils or other carbonaceous materials, which typically can be provided in an unending flow, to be treated by flowing the crude material through the deep well reactor.

For further explanation of the deep well reactor that can be used in embodiments of the present invention, attention is directed to FIG. 1. FIG. 1 shows a cased and cemented well. A conventional casing 10 is placed in the wellbore and is held in position by an external jacket of cement 12, the casing being cemented in the borehole. The cement has a specified depth of penetration beyond the casing 10, this depth being sufficient to adequately secure the casing in location and to also prevent migration along the exterior of the casing between various strata penetrated by the borehole. The well has a typical diameter dependent on the size of the drill bit used to form the well. Preferably, the well is in excess of 5,000 feet deep, although varying depths can be used depending on the particular pressure conditions desired for the hydrocracking reaction. The well at a depth of 8,000 feet provides a standing column of water that yields an adequate downhole pressure as will be described. A column of water at 8,000 feet tall, 705° F. at the bottom of the well will require a pressure boost of only about 350 psi to overcome reduced density resulting from the increasing temperature. As will be apparent, greater well depth will accordingly reduce surface pressure boost.

Within the casing 10 is disposed the reactor vessel 8, which can extend the full depth of the borehole or can be positioned only at the desired depth. The embodiment shown in FIG. 1 shows the reactor vessel 8 extending the full depth from the surface to the bottom of the well. An annular area 6 will thus be formed between the reactor vessel 8 and the casing 10. This annular space can be used, for example, as a space in which to provide various instrumentation used in conjunction with the reactor, such as heating elements, process control, and the like. The annular space can also serve to detect any leakage from the reactor, and to prevent that leakage from entering the environment.

The casing 10 is sealed at the top by a closure member 14. Various and sundry fluid conduits and electrical conductors pass through the top. Seals (not shown) of a suitable nature prevent leakage around the top. Moreover, the reactor vessel thus forms a pressure chamber within the well, and this is identified in the upper reaches of the well by the numeral 16. There is a reaction chamber 20 at the bottom of the reactor, this being located above a plug 22 positioned in the casing. The depth of the well is indefinite. Inasmuch as the well can be deeper, the plug 22 can be located at the bottom of the casing or substantially above the bottom end of the cased hole. Excess hole can be plugged off and isolated, if desired or necessary. The plug 22 is positioned within the bottom 100 feet of the casing.

Returning again to the upper end of the well, a source of process gas, such as hydrogen or synthesis gas, is connected to a pump 24 and is pumped through a tubing string 26. The tubing 26 extends to about 2,000 feet where the discharge nozzle 28 is located. The process gas is bubbled into the water; the process gas dissolves better above about 233° F., the temperature of minimum solubility. The discharge nozzle for the tubing 26 is concentrically within the crude material stream tubing 30. The tubing 26 delivers the process gas from the pump under pressure as will be described. The process gas is discharged through the nozzle 28 into the flowing crude material stream.

Suitable crude material is introduced into the well by means of a crude material supply line 30. This concentric tubing extends to the very bottom, giving perhaps six inches clearance over the plug. The clearance directs the flow to scour the bottom and flush all sediment, flowing with the effluent to the surface. Typically, the crude material includes the heavy oil and/or other carbonaceous materials that are exemplified above. Moreover, the crude material is delivered into the well in solution or as a mixture. Typically, the crude material stream has a high water content, as described below. The crude material may be generally characterized as including HC-M-S-N. The foregoing is not a chemical formula but simply represents the typical elements found in the crude material. Accordingly, HC refers to various hydrocarbons, M refers to metals (such as nickel, vanadium and iron), S is sulfur and N refers to nitrogen. Other elements may also be present, such as various halogens. The crude material may typically include both organic and inorganic compounds.

The crude material is introduced through a supply line 30. The supply line should be extended substantially toward the bottom of the well. This assures that the crude material (HC-M-S-N) is delivered to the reaction region 20. Typically, the reaction region 20 includes the bottom of the well and several hundred feet above the bottom.

The closure member 14 connects with an outlet line 32. The line 32 connects through a regulator valve 34. The valve 34 assists in discharging treated material. Preferably, the treated material simply flows to the top of the well and is discharged. As desired, the treated material may be collected and stored, or may be directly processed in a subsequent operation, such as in a refining operation.

The regulator valve maintains back pressure. It is desirable that the pressure at the bottom of the well be maintained in excess of the pressure necessary to assure that water is at a supercritical state. This pressure is about 3,200 psi (or as given in various journals as being 218.3 atmospheres). At this level of pressure, and at a temperature exceeding the critical temperature, the density, bonding with various molecules including hydrogen, and other physical properties of the water are altered. So to speak, the water then behaves more as a non-polar organic liquid, and as a catalyst in the process of the present invention. At this juncture, the solvency of the water is markedly changed. Water is an extremely good solvent for organic substances at this level. That is, oils and greases are miscible with water at this temperature and pressure. Moreover, the density of the water is reduced while inorganic salts become only slightly soluble. Not only do organic compounds (especially including oils and greases) become soluble in water at this state, but the process gas also becomes completely soluble in water. In summary, in the critical region, the hydrocarbons and gases carried in the water and the water itself become completely dissolved in one another. Inorganic salts are not soluble in supercritical water. They tend to settle out, or they are picked up and entrained by the flow, carried toward the surface and may redissolve as the water temperature is reduced. Such salts are normally discharged. The salts can then be suitably separated and processed or disposed of according to usual practices.

The cracked hydrocarbons of the crude material are rapidly reduced, or saturated with hydrogen, which results in the desired hydrocracking of the present invention. Assuming that there are also halogens or metals in the crude material, they form salts. These salts typically fall out and will be redissolved as the flow approaches the surface. Flowing water will entrain these along and out of the well as will be described.

Heating of the reaction chamber 20 should be considered. Briefly, a heating element 42 is connected to an electronic current or voltage source 38 via a conductor 40. The conductor 40 extends to the reaction chamber. The conductor 40 is sheathed or wrapped in an insulator so that there is no current flow from the conductor 40 along its length. Current flow through the element provides heat used to start the reaction. Other means of heating may, of course, be used. For example, as is known with conventional high pressure reactor equipment, heating elements may be attached to or contacted with the outer surface of the reactor vessel, to provide heating into the reactor vessel. Alternatively, it is envisioned that a short-lived chemical reaction can be conducted in the reactor vessel to provide an initial heat "charge" to start the reaction.

When the desired operating temperature is reached, or even before the desired operating temperature is reached, the pump 24 is switched. Process gas under pressure is forced through the conduit and is discharged at the tip 28. It should be noted that the process gas does not merely bubble from the tip. As supercritical conditions are approached, the solubility of hydrogen and other gases in water increases markedly to reduce bubble size as the process gas is dissolved. The process gas is simply dissolved into the water and is therefore available for reduction of the cracked crude material including HC-M-S-N. Heat causes cracking of the crude material, and the heat is replaced by the exothermic reaction between the reducing gases and the products of the cracking reaction. The reacting crude material and water mixture flows to the bottom of the well, conducting the gas along with it. Water is confined and hence is not able to flash into steam. In this state, the supercritical nature of the water is best defined by describing the water as a supercritical fluid, rather than a liquid. There is a change in density of the water in the chamber 20. However, it remains underneath the standing column of water. At supercritical conditions, the density eventually passes through the critical density of water, which is 0.325 g/cm$^3$. A continual flow of process gas is input with the continual flow of water including crude material. Water is then discharged at the top through the relief valve 34. The relief valve is adjusted to maintain a suitable back pressure on the system. This assures that the supercritical pressure is maintained in the chamber while dynamic inflow and outflow are maintained.

The process pressure, which is preferably at least 1,000 psi, and even more preferably at least 3,000 psi, as described above, is obtained by utilizing the well at a depth where such a pressure is sustained. If the well is not deep enough, then the back pressure valve 34 may be used to maintain a sufficient pressure head on the well. If the well were shorter, back pressure must be maintained on the system to assure that the pressure in the reaction chamber 20 is at or in excess of the desired reactor pressure. If the well is deeper, then the back pressure can be practically reduced to zero.

It is desirable that the crude material stream be supplied with a substantial portion of crude material to be processed in the hydrocracking operation. Once hydrocracking starts with crude material introduced into the chamber 20, such operation can continue. This enables the electric power source to be switched so that reduced current is needed. The electric heating provides the short fall, if any, of heat required to sustain the reaction. In one sense, the procedure is self-sustaining. That is, sufficient heat is liberated by the hydrocracking reaction of the HC-M-S-N in the vicinity of the chamber 20 that the chamber 20 is maintained at the operating temperature, and preferably at or above the supercritical temperature, as within the temperature ranges described above. Thus, the electric current can be thermostatically controlled, or even avoided, after the start of reaction within the reactor. The process is thus self-sustaining. It is ideally self-sustaining by the continued introduction of a sufficient flow of crude material.

When this state of affairs is achieved, the system operates without additional energy input at least to maintain supercritical conditions. The only inputs that are then required are the power inputs to the pumps. Because the crude material is typically delivered in aqueous solution, and process gas is also required, the two pumps constitute the sole or primary mechanisms consuming energy to sustain operation.

Some of the heat that is generated in the chamber 20 is lost into the surrounding earth. It is possible that the well will be sufficiently insulated so that the product stream 35, which is discharged, may be sufficiently hot that some energy can be recovered from it for operation of the pumps or other equipment. Thus, as long as a crude material feed is provided for the conversion apparatus, it is substantially self-sustaining. In addition, or alternatively, the heat from the product stream can be used in a heat exchange fashion to increase the temperature of the crude material feed stream as it passes down the well to the reactor.

As a practical matter, a small current flow protects the tubing and casing. At elevated temperatures and pressures experienced in the well, the gases of the process gas stream or reactant products thereof, including particularly carbon dioxide dissolved in the water, may attack the metal pipe and other components. Corrosion resistant stainless steel is expensive; but less expensive mild steel can be used if protected by a cathodic electrode system. This is dependent on the conditions; accordingly, the bottom fraction of pipe and tubing is preferably protected in this fashion.

As described briefly above, the downward flow of the feed water, crude material, and process gas and upward discharge of heated water and product provide a counter current heat exchange. The counterflows enable an adiabatic equilibrium to be sustained. The hot water discharge may deliver several million BTU per hour. A feed water pre-heater can use this heat to heat the feed water and/or crude material rather than waste the heat. In fact, dependent on the types and amounts of material in the crude material, the heat discharge of the well may exceed the energy required to operate the well, that energy being primarily pump power. This can be altered by changing the feed rate of reactants.

Safety is enhanced by placing the high pressure reactor chamber underground. The alternate choice is high pressure, high temperature surface-based equipment. Safety is assured by isolating the high pressure region underground. Costs are also reduced by this arrangement.

The well is, in a general sense, an insulated chamber. That is, there is controllable or limited heat loss, typically by virtue of the cement around the pipe. Further, the chamber at the bottom of the well is surrounded by subsurface formations at an elevated temperature, reducing the temperature differential and hence, the heat loss.

In general terms, the foregoing sets forth the procedure of operation of the present invention in a deep well reactor. It will be understood, of course, that the present invention can be conducted in a variety of different reactor systems, including conventional high pressure reactor systems.

In embodiments of the present invention, the pretreatment process of the crude material, i.e., the heavy oil and/or other carbonaceous materials, can be carried out either in a batch mode or a continuous mode. Thus, for example, depending on the volume of crude material to be processed, the size of the reactor, or other parameters, the reactor can be selectively operated in batch or continuous mode. For example, if a small volume of crude material is to be processed, it may be advantageous to operate the process in a batch mode. However, if large volumes of crude material are to be processed, where the crude material can be continuously supplied to the process, then it may be advantageous to operate the process in a continuous mode, where crude material is continuously fed to the reactor, and a processed product stream is continually withdrawn. The product stream could then in turn be continuously supplied to a subsequent operation, such as conventional refining operations.

Whether operated in batch or continuous mode, the feed stream to the reactor preferably includes water and the crude material. As desired, the water and crude material can be separately supplied to the reactor vessel, or they can be supplied in a single feed stream in a mixed, emulsified, or unmixed state. Mixing of the water and crude material prior to their being fed into the reactor chamber is unnecessary, as proper mixing is preferably provided within the reactor itself. In general, the volume of water preferably exceeds the volume of crude material being fed to the reactor. In embodiments, a ratio of water to crude material is preferably within the range of from about 1000:1 or from about 100:1 to about 1:1. In embodiments, for example, a ratio of water to crude material is preferably in the range of from about 10:1 to about 1:1, and more preferably is about 5:1. However, it will be understood that the ratio of water and crude material may be adjusted and selected depending on various parameters, including the specific type and properties of crude material, and the operational parameters of the reactor. Ratios outside of the above-specified ranges may thus be used, if desired.

Furthermore, as described above, a process gas is also fed to the reactor chamber concurrent with feed of the water and crude material. The process gas will be mixed with the water and/or crude material feed stream, part way into the reactor. Although the volume of process gas utilized in the processes of the present invention may vary depending upon the specific process gas and crude materials, the amount of process gas fed to the reactor is preferably a weight equal to from about 0.1 to about 100% of the weight of the crude material being processed. In embodiments, the amount of process gas is preferably a weight of from about 1 to about 75% of the weight of the crude material being processed. For example, when the process gas is hydrogen, smaller amounts of the process gas may be required to carry out the hydrocracking reaction. Thus, in these embodiments, the amount of process gas may be selected to provide a weight of process gas within a range of from about 1 to about 15% of the weight of the crude material, in preferably from about 2 to about 5% or about 3%/o of the weight of the crude material. However, where a synthesis gas is used, such as carbon monoxide, a higher weight of process gas, such as from about 20 to about 60 or from about 30 to about 50, percent of the weight of the crude material may be preferred. In embodiment where carbon monoxide is used as the process gas, adequate results may be obtained by using a weight of carbon monoxide equal to about 40% by weight of the crude material. Of course, more definitive information can be obtained by laboratory measurement.

Of course, amounts of process gas outside of the above-described ranges may be used, if desired. For example, the amount of process gas should preferably be selected to provide an amount equal to the amount theoretically consumed by the chemical reactions occurring within the reactor vessel. However, it would be apparent that amounts beyond the theoretical amount, i.e., an amount in excess of that required for the chemical reactions, may be fed into the reactor. Excess unreacted process gas can subsequently be collected and separated, and reused for further processing.

As described above, the reactor vessel is preferably operated to obtain temperature and pressure conditions within the range of supercritical for the water content of the reactor. These parameters can be achieved, for example, by pressurization and beating of the reactor contents and the feed streams. However, it is preferred in embodiments of the present invention that sufficient head space is maintained in the pressure vessel to allow both for liquid expansion of the water and crude material upon heating, and to permit gas addition of the process gas. Accordingly, it will be understood that the total quantity of reactants (water, crude material, and process gas) will depend upon the reactor volume and should be adjusted to provide the desired temperatures and pressures stated above.

An exemplary batch operation of the process of the present invention will now be described. In a first step of the process, water and crude material are placed within a pressure vessel. The water and crude material need not be mixed or emulsified, although they can be so mixed or emulsified if it is convenient to do so. The pressure vessel is then closed, and a reducing gas is introduced in sufficient quantity, or an excess, for the hydrocracking reaction. The gas is added via a valved connection, so that the pressure within the pressure vessel is elevated based on introduction of the process gas.

After the reactants (water, crude material, and process gas) are added, the pressure vessel and its contents are heating and mixed. The mixing can be accomplished by any suitable means, including by an internal stirrer, by shaking the entire vessel, or the like. The final temperature may be from about 300 to about 1000° F., although about 705° F. is preferred in embodiments. Likewise, the final pressure may be about 1500 psi, although about 2500 or about 3000 psi is preferred in embodiments. The temperature and pressure are then maintained and the contents mixed for a sufficient time to allow the desired reactions to occur. Although the time for the reaction to proceed will vary based, for example, on the properties of the specific crude material and other conditions in the reactor, the reactions are preferably carried out for a time of from about 10 to about 30 minutes.

Following completion of the desired reaction time, the contents of the pressure vessel are cooled, preferably to about 150° F. or below. However, cooling below typical ambient conditions, for example about 60° F., is not required. After cooling, the pressure vessel is depressurized by removing the gas. The gas fluent will typically contain excess process gas not consumed in the reaction, and may typically also contain light gases, which are products of the hydrocracking reactions, such as methane, ethane, propane, isobutane and n-butane. The gas fluent may also contain products resulting from the removal of sulfur and nitrogen from the crude material, such as hydrogen sulfide and ammonia. Separation of the gases for other uses or for recycle may be accomplished by conventional means.

Next, the water and the hydrotreated or hydrocracked product may be removed together and separated, for example by decanting. Reaction products dissolved in the water, such as ammonium sulfide, can be removed by standard methods of water purification. The water stream may then be discharged or recycled for future use.

With both water and gas removed, the hydrocracked product stream will be suitable for conventional processing.

Next, a continuous mode operation of the process of the present invention will be described.

To permit continuous operation of the reactor, each of the three main reactants, i.e., water, crude material and process gas, are continuously fed into the reactor. In general, the relative flow rates of the reactants will be the same as described above with respect to the batch process. As above, if convenient, the crude material and water may be mixed prior to entering the reactor, they may be fed in the same feed line but in separate phases, or they may be fed into the rector as separate feeds. To assist in heating of the reactants, the crude material and/or water may be heated by heat exchange with reaction products exiting the reactor.

The reactants are mixed within the reactor as they flow through the reactor. Such mixing may be accomplished in any suitable manner, such as by turbulent flow, by mixing devices disposed within the reactor to induce mixing in flowing system, and the like. Similarly, the temperature and pressure of the reactants within the reactor may be controlled by any suitable and conventional means typically utilized for flowing systems. The temperature and pressure of the continuous mode reactor will generally be comparable to those specified above for the batch mode reactor. However, as described above with respect to an exemplary deep well reactor, the required heat to maintain the reactor temperature at the desired level may be produced by the chemical reactions themselves, and excess introduction of heat to maintain the reaction may not be necessary once a steady state is achieved.

After reaching the preferred temperature and pressure, the flowing mixture within the reactor requires a residence time sufficient to permit the desired hydrocracking reaction to proceed. As with the batch mode reactor, the residence time within the continuous mode reactor is preferably from about 10 to about 30 minutes, depending, for example, on the properties of the crude material and other reaction conditions prevailing within the reactor. It will thus be apparent that shorter and longer residence times may be utilized, as necessary.

Following the required residence time, the mixed products are cooled by heat exchange to a temperature of from about 150° F. or lower. However, as above, cooling of the products below ambient temperature conditions, for example 60° F., is not required. After cooling, the mixed products are conveyed to a conventional vapor liquid separator or other device. Past this unit, the vapor and liquid product streams preferably travel through separate lines. The pressure within each product stream may be reduced using suitable valve assemblies, as is conventional in the art.

With respect to the liquid stream, the hydrocracked product and water may be separated in a conventional manner, such as by using a continuous-flow decanter. The separated water may even be treated by conventional means to remove reaction products, and subsequently disposed of or recycled for future use. Similarly, the gas product stream may be separated by conventional means, for recycle or other uses.

After the water and gas have been removed from the hydrocracked product stream, the hydrotreated or hydrocracked product will be suitable for conventional processing.

Although the present invention is described above with reference to specific materials and process steps, it will be appreciated by one of ordinary skill in the art that the process of the present invention can be practiced using any of a wide variety of materials, and in any of a wide range of methods. The present invention is not limited to the specific embodiments disclosed herein, and other embodiments are contemplated and within the scope of the invention.

EXAMPLES

Example 1

0.38 grams of Styrofoam plastic (obtained from a polystyrene picnic plate) and 2.53 grams of water are placed in a reactor at 9.8 mls total volume. The remaining space in the reactor is filled with hydrogen gas to a pressure of 290 psi. The reactor is heated rapidly (in about two minutes) to 750° F., which temperature is held approximately constant for 10 minutes while the contents are mixed by shaking the reactor. The reactor is then rapidly cooled to room temperature.

The reaction product contains a mixture of toluene, ethyl benzene, cumene, and similar hydrocarbons such as 1,3-dibenzopropane, and other products. In particular, the reactor contents do not include either benzene or wax.

Example 2

0.15 grams of oil shale and 2.5 grams of water are placed in a reactor at 9.8 mls total volume. The remaining space in the reactor is filled with hydrogen gas. The reactor is heated rapidly (in about two minutes) to 750° F., which temperature is held approximately constant for 60 minutes while the contents are mixed by shaking the reactor. The reactor is then rapidly cooled to room temperature.

The reaction product contains shale rock granules that settle out to the bottom, and a thin layer of oil floating on top of the water. The product gas contains hydrogen sulfide.

Example 3

A varied mixture of organic waste materials is prepared by reaction by fermentation in a solution of sodium carbonate. A sample of the product containing 18.6 grams of organic material, 400 grams of water, and about 80 grams sodium carbonate are placed in a reactor of approximately 1660 mls total volume. The remaining space in the reactor is filled with hydrogen gas to a pressure of 1085 psig. The reactor is heated gradually (in about 3.5 hours) to 680° F. and a pressure of about 4800 psig, which temperature and pressure are held approximately constant for 120 minutes while the contents are mixed by shaking the reactor. The reactor is then cooled to room temperature.

The organic reaction products contain a solid waxy product, organic materials dissolved in the water, and sodium carbonate, and the following gases: 3.8 mls methane, 7.4 mls ethane, 1.3 mls propane, and 0.69 mls mixed butanes. The waxy product weighing 8.2 grams is analyzed in a gas chromatograph to provide a simulated distillation and has a character somewhat resembling crude oil. The dissolved organic materials contain 0.48 grams of mixed ketones, 4.2 grams of pyridines and amines, and other similar compounds for a total of 7.9 grams of dissolved organic materials.

What is claimed is:

1. A process for treating a carbonaceous material, comprising:

reacting said carbonaceous material and a process gas in water in a reactor vessel to at least one of hydrotreat and hydrocrack said carbonaceous material, wherein said reacting is conducted at a temperature of at least about 300° F. and a pressure of at least 1000 psi and said reactor vessel is a deep well reactor.

2. The process of claim 1, wherein said carbonaceous material is a heavy oil.

3. The process of claim 1, wherein said process gas is selected from the group consisting of hydrogen, carbon monoxide, and mixtures thereof.

4. The process of claim 1, wherein said reaction step accomplishes at least one action selected from the group consisting of: reduce specific gravity of said carbonaceous material, increase hydrogen content of said carbonaceous material, reduce viscosity of said carbonaceous material, reduce average molecular weight of said carbonaceous material, remove heteratoms from said carbonaceous material, remove metals from said carbonaceous material, and remove halides from said carbonaceous material.

5. The process of claim 1, wherein said reaction step does not utilize a separate hydrotreating or hydrocracking catalyst.

6. The process of claim 1, wherein said reaction step does not utilize a solid hydrotreating or hydrocracking catalyst.

7. The process of claim 1, wherein said water functions as the only hydrotreating or hydrocracking catalyst present in said reactor.

8. The process of claim 1, wherein said deep well reactor is located in a well at least 5000 feet deep.

9. The process of claim 1, wherein said process operates in batch mode.

10. The process of claim 1, wherein said process operates in continuous mode.

11. The process of claim 1, wherein said reaction is conducted at a temperature of from about 300 to about 1000° F. and a pressure of from about 1000 psi to about 6000 psi.

12. The process of claim 1, wherein said reaction is conducted at a temperature of from about 600 to about 800° F. and a pressure of from about 2500 psi to about 3500 psi.

13. The process of claim 1, wherein the carbonaceous material and water are mixed prior to being fed into the reactor vessel.

14. The process of claim 1, wherein the carbonaceous material and water are mixed during or subsequent to being fed into the reactor vessel.

15. The process of claim 1, wherein said treated carbonaceous material is suitable for conventional refining.

16. The process of claim 1, wherein said reaction is conducted at a temperature and pressure at or above the critical point for water.

* * * * *